US007397032B2

(12) United States Patent
Zona et al.

(10) Patent No.: US 7,397,032 B2
(45) Date of Patent: Jul. 8, 2008

(54) NANO-STRUCTURE COATED CORONODES FOR LOW VOLTAGE CHARGING DEVICES

(75) Inventors: Michael F. Zona, Holley, NY (US); Joseph A. Swift, Ontario, NY (US); Dan A. Hays, Fairport, NY (US)

(73) Assignee: Xeorox Corporation, Norwalk, CT (US)

( * ) Notice: Subject to any disclaimer, the term of this patent is extended or adjusted under 35 U.S.C. 154(b) by 206 days.

(21) Appl. No.: 11/398,685

(22) Filed: Apr. 6, 2006

(65) Prior Publication Data

US 2007/0235647 A1 Oct. 11, 2007

(51) Int. Cl.
*G03G 15/02* (2006.01)

(52) U.S. Cl. ..... 250/326; 399/168

(58) Field of Classification Search ..... 250/326, 250/324; 399/168, 252, 289, 291; 361/225, 361/230; 355/219, 221, 225
See application file for complete search history.

(56) References Cited

U.S. PATENT DOCUMENTS

| | | | | |
|---|---|---|---|---|
| 5,539,205 | A * | 7/1996 | Reale | 250/326 |
| 6,459,870 | B1 * | 10/2002 | Lee | 399/115 |
| 6,756,174 | B2 * | 6/2004 | Van Vechten et al. | 430/120.2 |
| 7,149,460 | B2 * | 12/2006 | Hays | 399/252 |
| 7,228,091 | B2 * | 6/2007 | Hays et al. | 399/168 |

* cited by examiner

*Primary Examiner*—Kiet T Nguyen
(74) *Attorney, Agent, or Firm*—MH2 Technology Law Group LLP

(57) ABSTRACT

Electrophotographic charging devices that can be used to charge or discharge, for example, a receptor in the electrophotographic process are provided. According to various embodiments, the exemplary charging devices can include a coronode disposed opposing and spaced apart from a receptor, and a plurality of nanostructures, wherein each of the plurality of nanostructures has an end, edge, or side in electrical contact with the coronode. The exemplary charging devices including the nanostructures can use less power, i.e. voltage and/or current than conventional charging devices and produce a reduced amount of oxidizing agents, such as, ozone and $NO_x$. The nanostructures can serve to increase the intensity of the local electric fields for more efficient charge generation at reduced voltages.

19 Claims, 4 Drawing Sheets

NANO-STRUCTURE COATED CORONODES FOR LOW VOLTAGE CHARGING DEVICES

FIELD OF THE INVENTION

The subject matter of this invention relates to charging devices. More particularly, the subject matter of this invention relates to coronodes coated with nanostructures for use in an electrophotographic apparatus.

BACKGROUND

In the electrophotographic process, various charging devices are needed to charge a photoreceptor ("receptor"), recharge a toner layer, charge an intermediate transfer belt for electrostatic transfer of toner, or charge a sheet of media, such as a sheet of paper. Conventional non-contact charging devices typically apply high DC voltages to wires or pins, such as corotrons, scorotrons, and dicorotrons, to produce ions for charging. Problems arise because the undesired highly reactive oxidizing species that are also generated in the process degrade the photoreceptor and causes air pollution. Alternative contact charging devices use high AC voltages to charge small diameter drums. Problems arise because the undesired highly reactive oxidizing species that are also generated in the process degrade the photoreceptor and may cause air pollution. Alternative contact charging devices use high AC voltages to charge small diameter drums. Problems arise with contact charging devices because the reactants generated along with mechanical wear serve to also degrade the photoreceptor. Moreover, conventional charging devices require high voltages and a large size (e.g., the length in the process direction) for high process speed electrophotographic machines.

Thus, there is a need to overcome these and other problems of the prior art to provide a method and system for direct charging of the receptor, and to reduce the undesired reactive oxidizing species generated through the charging process.

SUMMARY

In accordance with the invention, there is an electrophotographic charging device including a receptor, a coronode disposed opposing and spaced apart from the receptor, and a plurality of nanostructures, wherein each of the plurality of nanostructures has an end in electrical contact with the coronode. The charging device can further include a first power supply that supplies a first voltage to the coronode.

In accordance with the invention, there is a method of charging a receptor in an electrophotographic charging device. The method can include providing a coronode comprising a plurality of nanostructures, wherein each of the plurality of nanostructures has a first end in electrical contact with the coronode. The method can further include providing a receptor spaced apart from the coronode and applying a first voltage to the coronode to generate charged species at a second end of the plurality of nanostructures. The receptor can then be charged by depositing charged species on the receptor.

It is to be understood that both the foregoing general description and the following detailed description are exemplary and explanatory only and are not restrictive of the invention, as claimed.

The accompanying drawings, which are incorporated in and constitute a part of this specification, illustrate one several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

As used herein, the term "nanostructure" refers to single-walled (for example, carbon) nanotubes (SWNT), multi-walled nanotubes (MWNT), horns, spirals, as well as rods, wires, cones, and/or fibers formed from various conductive materials. The nanostructures can have any regular or irregular cross-sectional shape including, for example, round, oval, elliptical, rectangular, square, tapered, and the like. Typically, in various embodiments individual nanostructures have a width if non-circular or diameter if round of about 1 to about 500 nanometers, or from about 10 to 200 nanometers and a length of up to hundreds of microns. By controlling various parameters, such as composition, shape, length, etc., the electrical, mechanical, and thermal properties of the nanostructures can be controlled. For example, the nanostructures can be formed to be conducting or semi-conducting depending on, for example, the chirality of the nanostructures in the case of carbon nanotubes. Moreover, nanostructures such as carbon nanotubes can have mechanical properties such as yield stresses greater than that of steel. Additionally, carbon nanotubes can have thermal conductivities greater than that of copper, and in some cases, comparable to, or greater than that of diamond.

Figure 1:
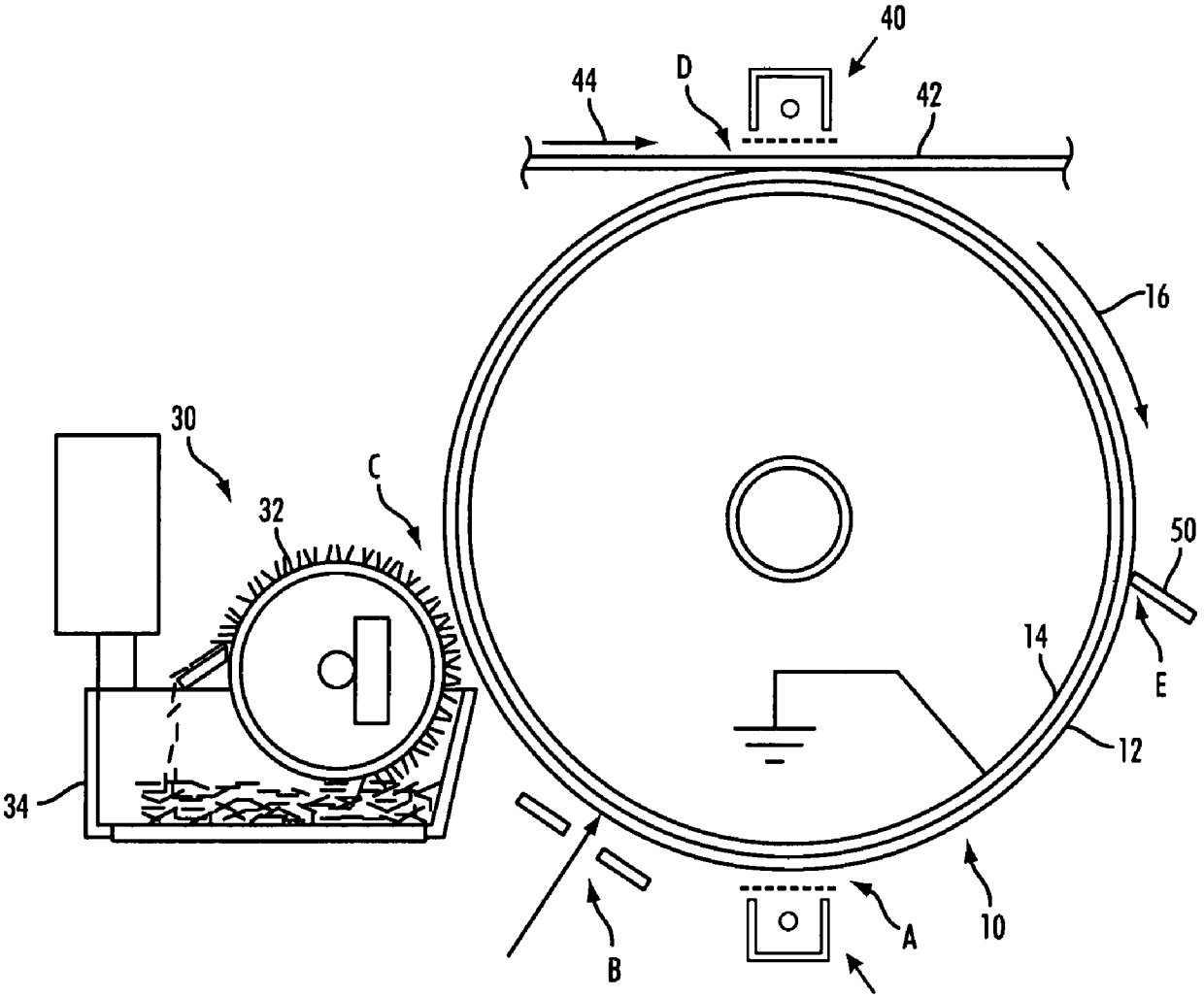
FIG. 1 is a schematic view showing an electrophotographic printing apparatus according to various embodiments of the invention.

Referring initially to FIG. 1, prior to describing the specific features of the exemplary embodiments, a schematic depiction of the various components of an exemplary electrophotographic reproduction apparatus incorporating charging devices, various embodiments of which are described in more detail below, is provided. Although the exemplary apparatus is particularly well adapted for use in an electrophotographic reproduction machine, it will be apparent from the following discussion that the present charging devices are equally well suited for use in a wide variety of electrostatographic processing machines as well as other systems that include the use of a charging device. In particular, it should be noted that the charging devices of the exemplary embodiments can also be used in the toner transfer, detack, erase, or cleaning subsystems of a typical electrostatographic copying or printing apparatus because such subsystems can include the use of a charging device.

The exemplary electrophotographic reproducing apparatus of FIG. 1 can include a drum with a photoconductive surface 12 deposited on an electrically grounded conductive substrate 14. A motor (not shown) can engage with drum 10 for rotating the drum 10 in the direction of arrow 16 to advance successive portions of photoconductive surface 12 through various processing stations disposed about the path of movement thereof, as will be described. Initially, a portion of drum 10 passes through charging station A. At charging station A, a charging device, indicated generally by reference numeral 20, charges the photoconductive surface 12 on drum 10.

Once charged, the photoconductive surface 12 can be advanced to imaging station B where an original document (not shown) can be exposed to a light source (also not shown) for forming a light image of the original document onto the charged portion of photoconductive surface 12 to selectively dissipate the charge thereon, thereby recording onto drum 10 an electrostatic latent image corresponding to the original document.

One of ordinary skill in the art will appreciate that various methods can be used to irradiate the charged portion of the photoconductive surface 12 for recording the latent image thereon. For example, a properly modulated scanning beam of electromagnetic radiation (e.g., a laser beam) can be used to irradiate the portion of the photoconductive surface 12.

After the electrostatic latent image is recorded on photoconductive surface 12, the drum is advanced to development station C where a development system, such as a so-called magnetic brush developer, indicated generally by the reference numeral 30, deposits developing material onto the electrostatic latent image. The magnetic brush development station may be combined or integrated with one or more other devices, such as for example the charger 20 or the drum 10, into a single cartridge, also referred to as a xerographic replaceable unit, which enables easy service and/or replacement.

The exemplary development system 30 shown in FIG. 1 includes a single development roller 32 disposed in a housing 34, in which toner particles are typically triboelectrically charged by mixing with larger, conductive carrier beads in a sump to form a developer that is loaded onto developer roller 32 that can have internal magnets to provide developer loading, transport, and development. The developer roll 32 having a layer of developer with the triboelectric charged toner particles attached thereto can rotate to the development zone whereupon the magnetic brush develops a toner image on the photoconductive surface 12. It will be understood by those of ordinary skill in the art that numerous types of development systems can be used.

Referring again to FIG. 1, after the toner particles have been deposited onto the electrostatic latent image for development, drum 10 can advance the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 can be provided for creating an electrostatic charge on the backside of support material 42 to aid in inducing the transfer of toner from the developed image on photoconductive surface 12 to the support material 42.

After image transfer to support material 42, support material 42 can be subsequently transported in the direction of arrow 44 for placement onto a conveyor (not shown) which advances the support material 42 to a fusing station (not shown) that permanently affixes the transferred image to the support material 42 thereby for a copy or print for subsequent removal of the finished copy by an operator.

According to various embodiments, after the support material 42 is separated from the photoconductive surface 12 of drum 10, some residual developing material, paper debris, or contaminants can remain adhered to the photoconductive surface 12. Thus, a final processing station, such as cleaning station E, can be provided for removing residual toner particles from photoconductive surface 12 subsequent to separation of the support material 42 from drum 10.

Cleaning station E can include various mechanisms, such as a simple blade 50, as shown, or a rotatably mounted fibrous brush (not shown) for physical engagement with photoconductive surface 12 to remove toner particles therefrom. Cleaning station E can also include a discharge lamp (not shown) for flooding the photoconductive surface 12 with light in order to dissipate any residual electrostatic charge remaining thereon in preparation for a subsequent image cycle.

According to various embodiments, an electrostatographic reproducing apparatus may take the form of several well known devices or systems. Variations of the specific electrostatographic processing subsystems or processes described herein can be applied without affecting the operation of the present teachings.

FIGS. 2-6 depict various charging devices that can be used to charge or discharge, for example, a receptor in the electrophotographic process. According to various embodiments, the exemplary charging devices described herein can include a coronode disposed opposing and spaced apart from a receptor, and a plurality of nanostructures, wherein each of the plurality of nanostructures has an end, edge, or side in electrical contact with the coronode. The exemplary charging devices including the nanostructures can use less power, i.e. voltage and/or current than conventional charging devices and produce a reduced amount of oxidizing agents, such as, ozone and $NO_x$. The nanostructures serve to increase the intensity of the local electric fields for more efficient charge generation at reduced voltages. Furthermore, the generation of undesired oxidizing agents is reduced since the volume of gas required for the charge generation process can be much smaller in comparison to the operation of coronodes without nanostructure coatings.

Figure 2:
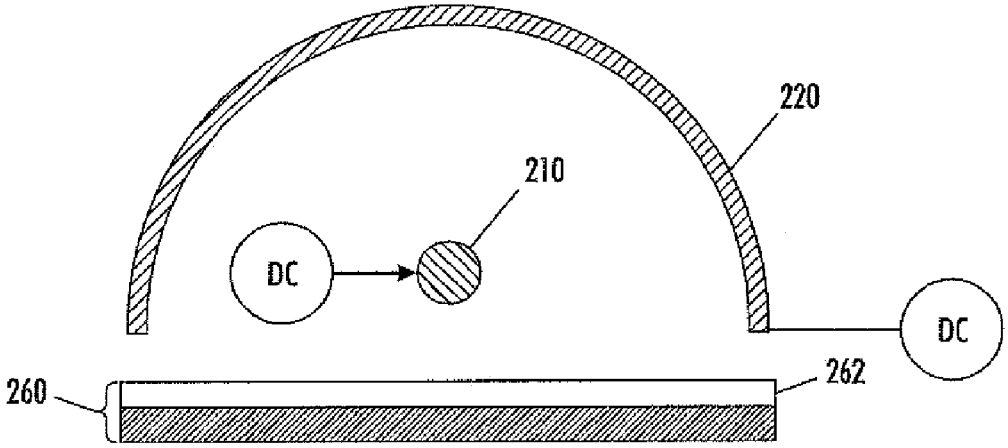
FIG. 2 depicts an exemplary charging device including a coronode with a plurality of nanostructures according to various embodiments of the invention.

FIG. 2 shows a cross sectional view of a corotron-type charging device 200 in accordance with the present teachings. Charging device 200 can include a coronode 210 and a conductive shield 220 partially surrounding coronode 210 such that an opening of conductive shield 220 faces a receptor 260. Receptor 260 can include a photoconductive surface 262. Photoconductive surface 262 can be disposed opposing and apart from coronode 210. One of ordinary skill in the art will understand that exemplary receptors can also include a toner layer, a sheet of media on which toner can be deposited, or a transfer belt. In various embodiments receptor 260 can include a drum having a diameter of 120 mm or less.

Coronode 210 can be, for example, a single wire coronode or an array of wire coronodes formed of tungsten or its alloys, stainless steel, platinum, rhenium, molybdenum or other conductive materials known to one of ordinary skill in the art. In various embodiments coronode 210 can be a circular shaped wire coronode having a diameter of about 25 microns to about 500 microns. Alternatively, the coronode can have any cross sectional shape including oval, tear-drop shaped, multi-lobal, including trilobal, and the like.

Figure 3:
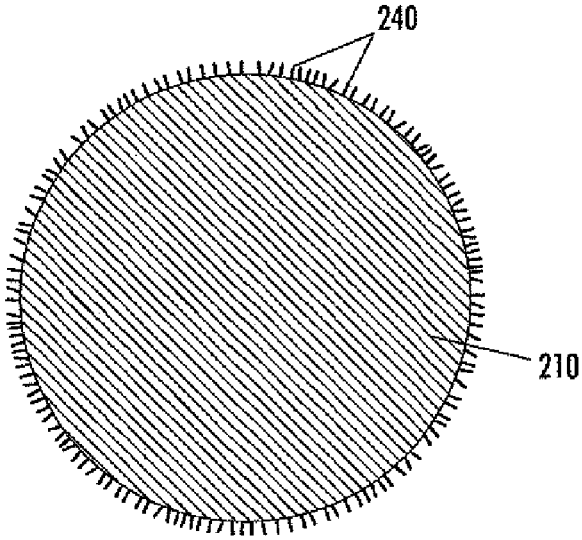
FIG. 3 depicts an exemplary wire coronode with a plurality of nanostructures according to various embodiments of the invention.

According to various embodiments, a plurality of nanostructures 240 can be attached to the surface of coronode 210 such that one end of the nanostructures 240 are in electrical contact with coronode 210 as shown in FIG. 3. Nanostructures 240 can be attached to the surface of coronode 210 by various methods including, but not limited to, soldering and a conductive adhesive. Nanostructures 240 can be conductive and formed of one or more of single-walled (for example, carbon) nanotubes (SWNT), multi-walled nanotubes (MWNT), rods, cones, wires, and fibers. Nanostructures can be formed of one or more elements from Groups IV, V, VI, VII, VIII, IB, IIB, IVA, and VA, including metals and alloys and mixtures of these elements. As used herein, notation for element groupings refer to the GAS (Chemical Abstract System) notation system. Nanostructures 240 can be fabricated by a number of methods including, but not limited to, arc discharge, pulsed laser vaporization, chemical vapor deposition (CVD), vapor deposition, electrodeposition, electroless deposition, vacuum metallization, electro-plating, electroless plating, and high pressure carbon monoxide processing. However, it will be understood by one of ordinary skill in the art that other fabrication methods can also be used. According to various embodiments, the nanostructures 240 can be formed to have their principle axis essentially perpendicular to the surface of wire coronode 210. Nanostructures can have a diameter of about 10 nm to about 500 nm. The aspect ratio of nanostructures 240 can be defined as the ratio of the nanostructure's length to the nanostructure's width or diameter. In various embodiments, the aspect ratio of the nanostructures can be 2 or more.

In operation, shield 220 can be grounded and a DC voltage applied to coronode 210. The DC voltage supplied by a power supply can generate charged species, such as, for example, electrons and/or gaseous ions at an end of each of the plurality of nanostructures to charge or discharge photoconductor surface 262. While not intending to be limited to any particular theory, it is believed that by applying the voltage to wire coronode 210 the field strength at an end of nanostructures 240 can exceed the threshold electric field for generating charged species such as electrons and/or gaseous ions. The high electric field at the tips of nanostructures 240 can create a positive ion, or a free electron and/or a negative ion. The charge species can collide with other gas molecules or atoms, potentially ionizing those molecules/atoms to generate additional charge species that can move to photoconductor surface 262. According to various embodiments, the voltage threshold for charge emission can be about 4000V or less. In various other embodiments, a second voltage can be applied to shield 220 to regulate the flow of charged particles to photoconductive surface 262.

Figure 4:
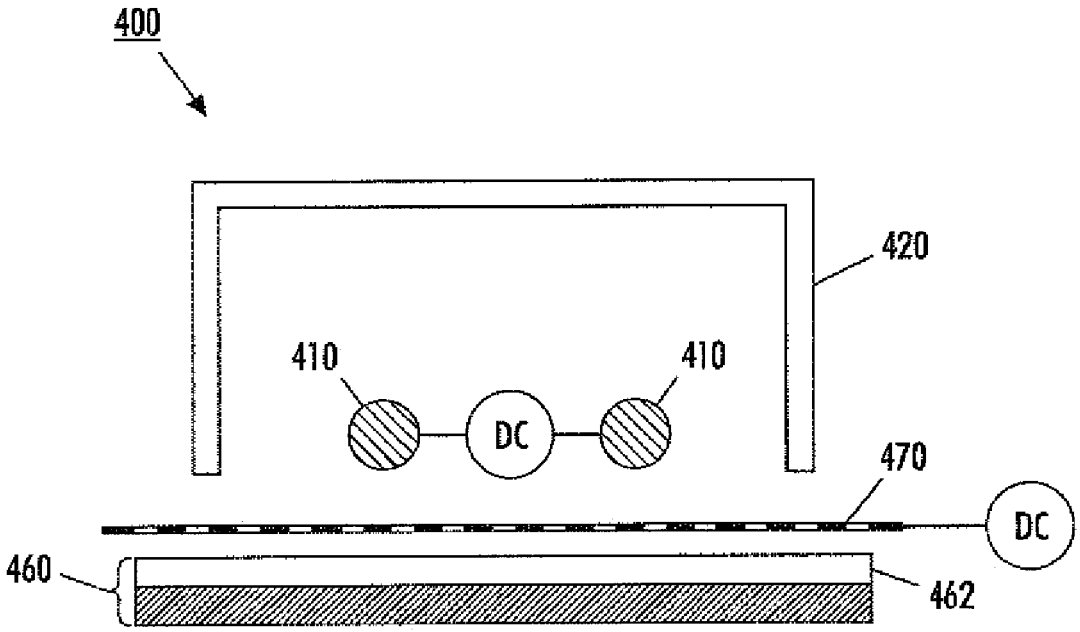
FIG. 4 depicts an exemplary scorotron charging device including coronodes with a plurality of nanostructures according to various embodiments of the invention.
Figure 5:
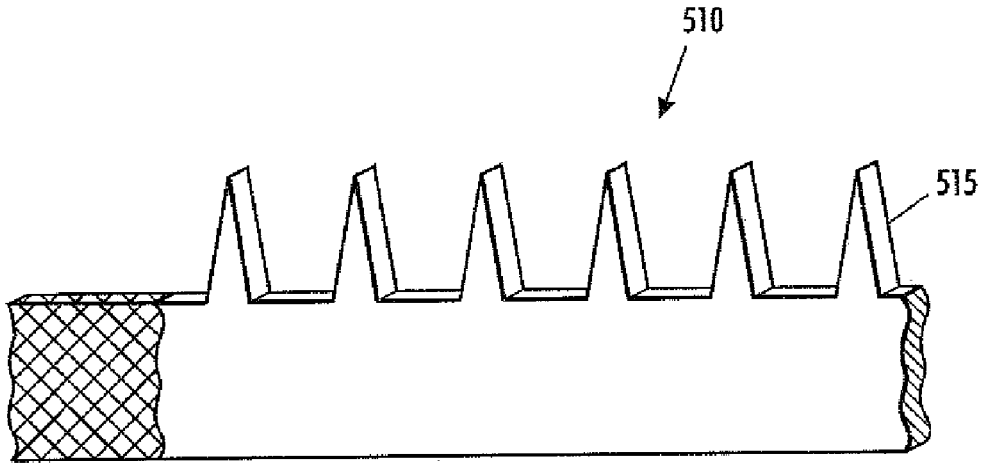
FIG. 5 depicts an exemplary array of pin coronodes with a plurality of nanostructures according to various embodiments of the invention.

According to other embodiments as shown in FIG. 4, a scorotron-type charging device 400 in accordance with the present teachings can include one or more coronodes 410 and a conductive shield 420 partially surrounding coronode 410 such that an opening of the conductive shield faces a receptor 460. Receptor 460 can include a photoconductive surface 462. Photoconductive surface 462 can be disposed opposing and apart from coronodes 410. According to various embodiments, a plurality of nanostructures can be attached to a surface of wire coronode 410 such that one end of the nanostructures is in electrical contact with coronode 410 in a manner similar to nanostructures 240 shown in FIG. 3.

Charging device 400 can further include a screen 470 disposed between coronode 410 and photoconductive surface 462 to control charging or discharging. Screen (or "grid") 470 can be formed of a conductive material and can be configured in a fashion known to one of ordinary skill in the art.

In operation, shield 420 can be grounded and a DC voltage applied to coronodes 410. The DC voltage supplied by a power supply can generate charged species, such as, for example, electrons and/or gaseous ions at an end of each of the plurality of nanostructures to charge or discharge photoconductor surface 462. Screen 470 can be biased with a potential close to that desired at photoconductor surface 462 using a second power supply to prevent the potential at photoconductor surface 462 from rising above the potential of screen 470. As disclosed above, it is believed that by applying the voltage to wire coronodes 410 the field strength at an end of the nanostructures can exceed the threshold electric field for generating charged species such as electrons and/or gaseous ions that can move to photoconductor surface 462. According to various embodiments, the voltage threshold for charge emission can be about 4000V or less. According to various embodiments, the threshold electric field can be about 6 V/μm or less.

In accordance with the present teachings, one or more arrays of pin-type coronodes can also be used in the exemplary charging devices. Referring to the side view of FIG. 5, a charging device can include an array 510 of pin coronodes 515. Array 510 can be an elongated conductive member including a plurality of saw-tooth shaped projections or pins 515. Pins 515 can extend toward the surface to be charged, e.g., photoconductive surface 262 in FIG. 2 and 462 in FIG. 4. Array 510 can be formed using conventional methods, such as laser cutting, chemical etching, or by non-chemical etching methods including but not limited to mechanical stamping.

Figure 6:
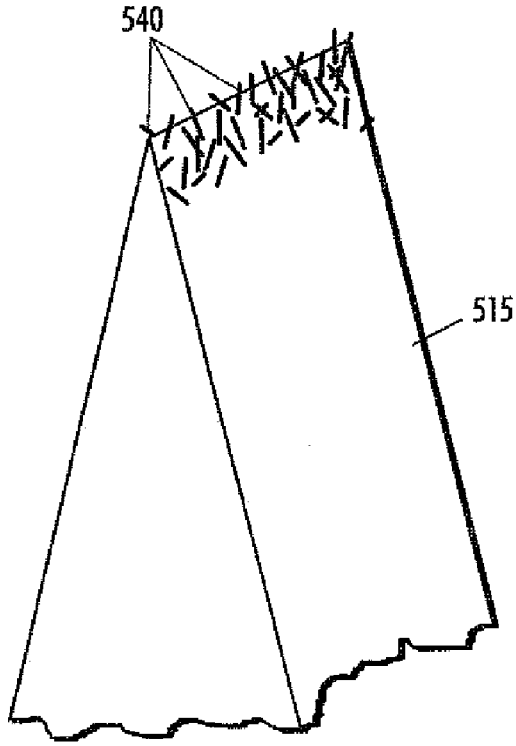
FIG. 6 depicts a perspective view of a pin coronode with a plurality of nanostructures according to various embodiments of the invention.

A plurality of nanostructures 540 can be attached to the surface at or near a tip of each pin 515 of array 510 such that one end, edge, or side of the nanostructures 540 is in electrical contact with pin 515 as shown in FIG. 6. It should be appreciated that the term "end" referred to herein is also intended to mean edge or side of the subject nanostructure. As discussed above, nanostructures 540 can be conductive and formed of one or more of single-walled (for example, carbon) nanotubes (SWNT), multi-walled nanotubes (MWNT), rods, wires, cones, and fibers. Nanostructures 540 can be formed of one or more elements from Groups IV, V, VI, VII, VIII, IB, IIB, IVA, and VA, including metals and alloys and mixtures of these elements. Further, nanostructures 540 can be fabricated by a number of methods including, but not limited to, vapor deposition, vacuum metallization, electro-plating, electroless plating, and high pressure carbon monoxide processing. Alternatively, a suitable resin, solder, or adhesive can be used to secure the nanostructures to the coronodes' surface. In various other embodiments, nanoporous templates can be used to form nanostructures 540. Examples of nanoporous templates includes polycarbonate track etched (PCTE) membranes (e.g., from Sterlitech Co., Kent, Wash.) and alumina templates, for example, formed by anodic oxidation. For example, a conductive layer can be deposited on a bottom surface of the nanoporous template. The pores of the nanoporous template can extend from a top surface of the porous template to the conductive layer. The conductive layer can be attached to a tip of the pin-type coronode and the pores can be filled with a conductive material. The nanoporous template can then be removed to form the plurality of nanostructures on the tip of the pin-type coronode. However, it will be understood by one of ordinary skill in the art that other fabrication methods can also be used.

The charging device including one or more arrays of pin corondes can operate in a manner similar to the charging devices including a wire coronode. For example, a DC voltage supplied by a power supply can generate charged species, such as, for example, electrons and/or gaseous ions at an end of each of the plurality of nanostructures to charge or discharge the photoconductor surface. As discussed above, it is believed that by applying the voltage to the array of pin coronodes 510 the field strength at an end of nanostructure 540 can exceed the threshold electric field for generating charged species such as electrons and/or gaseous ions. The high electric field at the tips of the nanostructures can create a positive ion, or a free electron and/or a negative ion. The charge species can collide with other gas molecules or atoms, potentially ionizing those molecules/atoms to generate additional charge species that can move to the photoconductor surface. The voltage threshold for charge emission can be about 4000V or less. In various embodiments, a screen can be disposed between pin array 510 including the plurality of pin-type coronodes 510 and the photoconductor screen. The photoconductor screen can be biased with a potential close to that desired at the photoconductor surface by a second power supply (not shown) to prevent the potential at the photoconductor surface from rising above the potential of the screen.

One of ordinary skill in the art will recognize that the corotron and scorotron configurations disclosed herein are exemplary and that other configurations can be used that include a plurality of nanostructures attached to the surface of the coronode. Further, it should be appreciated that, while disclosed systems and methods have been described in conjunction with exemplary electrophotographic and/or xerographic image forming devices, systems and methods according to this disclosure are not limited to such applications. Exemplary embodiments of systems and methods according to this disclosure can be advantageously applied to virtually any device to which charge is to be imparted.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrophotographic charging device comprising:

a receptor;

a coronode disposed opposing and spaced apart from the receptor;

a plurality of nanostructures, wherein each of the plurality of nanostructures has an end in electrical contact with the coronode; and a first power supply that supplies a first voltage of less than 4000V to the coronode, the coronode generating a charged species exceeding a threshold electric field of about 6V/μm at distal ends of each of the plurality of nanostructures.

2. The electrophotographic charging device according to claim 1, wherein the coronode comprises one or more of a single wire coronode, an array of wire coronodes, and an array of pin coronodes.

3. The electrophotographic charging device according to claim 1, wherein the plurality of nanostructures comprise one or more of single-walled nanotubes (SWNT), multi-walled nanotubes (MWNT), rods, wires, cones, and fibers.

4. The electrophotographic charging device according to claim 1, wherein the nanostructures comprise one or more elements from Groups IV, V, VI, VII, VIII, IB, IIB, IVA, and VA.

5. The electrophotographic charging device according to claim 1, wherein the nanostructures have a diameter or width of about 10 to about 500 nanometers.

6. The electrophotographic charging device according to claim 1, further comprising a conductive shield, wherein the conductive shield partially surrounds the coronode.

7. The electrophotographic charging device according to claim 1, further comprising:

a screen disposed between the coronode and the receptor; and a second power supply that supplies a second voltage to the screen.

8. The electrophotographic charging device according to claim 1, wherein the coronode comprises a wire having a diameter of 25 microns or more.

9. The electrophotographic charging device according to claim 1, wherein the coronode comprises an array of pin coronodes formed by one of chemical etching, laser cutting, and mechanical stamping.

10. The electrophotographic charging device according to claim 1, wherein the receptor comprises a drum having a diameter of 40 millimeters or less.

11. The electrophotographic charging device according to claim 1, wherein the plurality of nanostructures are attached to the coronode by one of a solder and a conductive adhesive.

12. A printing device comprising:

the electrophotographic charging device according to claim 1.

13. A method of charging a receptor in an electrophotographic charging device, the method comprising:

providing a coronode comprising a plurality of nanostructures, wherein each of the plurality of nanostructures has a first end in electrical contact with the coronode;

providing a receptor spaced apart from the coronode;

applying a first voltage of less than about 4000V to the coronode to generate charged species exceeding a threshold electric field of about 6V/μm at a second end of the plurality of nanostructures; and charging the receptor by depositing charged species on the receptor.

14. The method of claim 13, wherein the first voltage is a DC voltage, and wherein a second voltage is applied to a shield disposed spaced apart from and partially surrounding the coronode to regulate flow of the charged species to the receptor.

15. The method of claim 13, further comprising:

providing a screen between the coronode and the receptor; and applying a second voltage to the screen, wherein the second voltage is lower than the first voltage.

16. A method of forming a pin-type coronode comprising:

providing at least one pin-type coronode;

attaching a plurality of nanostructures to the at least one pin-type coronode such that an end of each of the plurality of nanostructures is in electrical contact with the at least one pin-type coronode, wherein the nanostructures have a diameter from about 10 nm to about 500 nm and a length of about 1 micron to about 500 microns.

17. An array of pin-type coronodes, wherein each pin-type coronode of the array is formed by the method of claim 16.

18. A method of forming a wire-type coronode comprising:

providing at least one wire-type coronode;

attaching a plurality of nanostructures to the at least one wire-type coronode such that one end of each of the plurality of nanostructures is in electrical contact with the at least one wire-type coronode, wherein the nanostructures have a diameter from about 10 nm to about 500 nm and a length of about 1 micron to about 500 microns.

19. The method of claim 18, wherein the plurality of nanostructures are fabricated by one of arc discharge, pulsed laser vaporization, chemical vapor deposition (CVD), electrodeposition or electroplating, electroless deposition, and high pressure carbon monoxide processing.

* * * * *

UNITED STATES PATENT AND TRADEMARK OFFICE

CERTIFICATE OF CORRECTION

PATENT NO. : 7,397,032 B2
APPLICATION NO. : 11/398685
DATED : July 8, 2008
INVENTOR(S) : Michael F. Zona, Joseph A. Swift and Dan A. Hays It is certified that error appears in the above-identified patent and that said Letters Patent is hereby corrected as shown below:

On the Title Page,
Item (73) should read Xerox Corporation, Norwalk, CT (US)

Signed and Sealed this

Nineteenth Day of August, 2008

JON W. DUDAS
*Director of the United States Patent and Trademark Office*